US006557213B1

(12) United States Patent
Winn

(10) Patent No.: US 6,557,213 B1
(45) Date of Patent: May 6, 2003

(54) CLOSED LOOP PUSH/PULL SYSTEM FOR A COTTON GIN

(76) Inventor: William E. Winn, 1301 First St., Levelland, TX (US) 79336

( * ) Notice: Subject to any disclaimer, the term of this patent is extended or adjusted under 35 U.S.C. 154(b) by 0 days.

(21) Appl. No.: 10/115,078

(22) Filed: Apr. 4, 2002

(51) Int. Cl.[7] ..... D01B 1/04

(52) U.S. Cl. ..... 19/48 R; 19/66 CC; 19/65 A

(58) Field of Search ..... 19/48 R, 0.27, 19/39, 40, 65 R, 200, 204, 205, 65 A, 66 CC; 68/5 D, 5 E; 406/106

(56) References Cited

U.S. PATENT DOCUMENTS 4,031,593 A * 6/1977 Vandergriff ..... 19/0.27
4,143,470 A * 3/1979 Vandergriff ..... 19/0.27
5,233,764 A * 8/1993 Vandergriff ..... 34/369
5,727,909 A * 3/1998 Laird ..... 406/106
6,038,741 A * 3/2000 Winn ..... 19/39
6,147,327 A * 11/2000 Winn ..... 19/0.27
6,202,258 B1 * 3/2001 Winn ..... 19/39

* cited by examiner

*Primary Examiner*—Gary L Welch
(74) *Attorney, Agent, or Firm*—Finnegan, Henderson, Farabow, Garrett & Dunner, L.L.P.

(57) ABSTRACT

A closed loop push/pull system of the present invention employs a hot shelf tower dryer and a plurality of fans uniquely positioned throughout portions of the cotton gin to direct and recirculate air through the cotton gin. Because the system employs a hot shelf tower dryer, the conventional introduction and circulation of hot air from a burner and fan assembly, after the primary burner, is no longer necessary. Instead, the hot shelf tower dryer provides heat to the cotton through its heated shelves, this heat being provided to and circulated between the shelves by a burner and fan assembly. Since this heated air is not directly exposed to the cotton, it may be recirculated between the shelves of the tower dryer and the burner and fan assembly. By limiting conventional drying methods and by recirculating the air streams conveying the cotton, the system reduces the emission of pollutants into the atmosphere.

12 Claims, 2 Drawing Sheets

CLOSED LOOP PUSH/PULL SYSTEM FOR A COTTON GIN

BACKGROUND OF THE INVENTION

1. Field of the Invention

The present invention concerns an aspect of the design and operation of cotton gins. More specifically, the present invention is directed toward a system and related method for recirculating air in a cotton gin.

2. Description of the Prior Art

Since the cotton gin was first developed by Eli Whitney more than a century ago, the basic task of separating seeds, plant material, and other objects from the fibers of the cotton has remained a primary concern among cotton ginners. These various objects or "trash" are typically collected together with the raw cotton when it is harvested, and must be separated from the cotton fibers before the cotton can be processed into thread and, ultimately, into fabric.

Although many configurations of processing machinery are possible, and generally well known, typically, upon arrival to a cotton gin, the raw or harvested cotton is first received by a dryer system, such as a tower dryer, followed by either an extractor or cleaner. The tower dryer subjects the cotton to previously generated heat to adjust the moisture content of the cotton in order to facilitate the ginning of the cotton. This heat is generated by a conventional burner and fan assembly, in which the cotton is directly exposed to and conveyed by this heated stream of air. After exiting the dryer system, the cotton travels to either an extractor or cleaner. The extractor removes larger objects, such as burrs or sticks, while the cleaner removes smaller objects, such as seeds or plant material.

To initially convey the cotton from the dryer to the extractor or cleaner, the burner and fan assembly, located in line before the inlet of the dryer, directs a heated air stream toward the inlet, thus, projecting the cotton and other objects toward the inlet. This same burner and fan assembly, or another similar assembly, provides the heated air stream to the tower dryer that facilitates the drying of the cotton. Once exiting the extractor or cleaner, the cotton continues through the cotton gin for further ginning, as conveyed by an air stream generated by another burner and fan assembly. After completing this process, the cotton remains in the gin, while the independent air streams, now including trash and other particles separated from the cotton, exhausts into the atmosphere. Each individual air stream, originating from the different burner and fan assemblies, must exhaust into the atmosphere because each burner requires new air. Indeed, the provision of used air or air containing small trash or lint to a burner and fan assembly presents the danger of fire, as the small trash or lint may ignite due to the high temperatures in the burner. For this reason, after an air stream comes in contact with the cotton and other debris residing in the cotton, it is expelled from the cotton gin, as its conveyance to another burner and fan assembly would introduce the risk of fire to the ginning process.

Cotton gins have also employed air flow systems using multiple burner and fan assemblies positioned at both the entrance and the exit of the gin. For example, in the initial conveyance of the cotton, the gin may employ a burner and fan assembly located in line before the inlet of the tower dryer that creates a heated air stream pushing the cotton forward. As positioned, the assembly directs a heated air stream toward the tower dryer and continuing to the extractor or cleaner to project the cotton and other objects into the extractor or cleaner. Again, this same burner and fan assembly, or another similar assembly, also provides heated air to the tower dryer in order to dry the cotton. Additionally, another burner and fan assembly, employing a pull fan, may be positioned in line after the outlet of the extractor or cleaner to pull the cotton along for further processing.

But inherent in each of these systems is the continued exhaust of air streams of trash and other particles into the atmosphere. In this increasingly environmentally-conscious marketplace, the unhampered exhaust of air including particles of trash violates regulations on pollution. The inability of conventional cotton gins to incorporate features that continue to maximize the operation and efficiency of cotton ginning, while reducing the amount of pollution expelled into the environment has created a specific need for alternative techniques for directing air flow through the cotton gin.

The present invention addresses these concerns by providing an air flow system that maximizes efficiency while reducing pollutant emissions.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the closed loop push/pull system of the present invention employs a hot shelf tower dryer and a plurality of fans uniquely positioned throughout portions of the cotton gin to direct and recirculate air through the cotton gin. Because the system employs a hot shelf tower dryer, the conventional introduction and circulation of hot air from a burner and fan assembly, after the primary burner, is no longer necessary. Instead, the hot shelf tower dryer may adjust the moisture content of the cotton through its heated shelves, the shelves being internally heated by hot air provided by a burner and fan assembly. The provision of the hot shelf tower dryer reduces the need for new air and limits the expulsion of air into the atmosphere caused by conventional drying methods, because much of the heated air is recirculated within the system.

To convey the cotton, the closed loop push/pull system provides a first fan, positioned before the hot shelf tower dryer, that provides an air stream conveying the cotton toward the dryer, so that the dryer, through its heated shelves, may adjust the moisture content of the cotton. The air stream continues to convey the cotton from the dryer to a cleaner or extractor of the cotton gin, so that trash may be separated from the cotton. Once separated, the air stream continues to convey the separated trash to a collector to separate the trash from the air stream conveying it. At minimum, the system further includes a second fan, positioned after the collector, that generates an air stream that withdraws the separated air from the collector and conveys it to a filtering system to clean the air. The cleaned air may then be pulled from the filtering system to the first fan, so that it may be recirculated through the system. Alternatively, the cleaned air may be directed before either the cleaner or the extractor for recirculation. By limiting conventional drying methods (i.e., exposing the cotton directly to a heated air stream) and by recirculating much of the air, by using fans that generate air streams that push as well as pull air, the system maintains the efficiency of the cotton gin, while reducing the emission of pollutants into the atmosphere. The number of fans employed by the system depends upon the number of dryers, cleaners/extractors, and collectors used in the cotton gin.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate preferred embodiments of the invention and, together with the description, serve to explain the principles of the invention. In the drawings.

DESCRIPTION OF THE PREFERRED EMBODIMENTS

Reference will now be made in detail to the present preferred embodiments of the invention, an example of which is illustrated in the accompanying drawings. Wherever possible, the same reference numbers will be used throughout the drawings to refer to the same or like parts.

In accordance with the present invention there is provided a closed loop push/pull system for a cotton gin that includes a hot shelf tower dryer and a plurality of fans uniquely positioned throughout portions of the cotton gin to direct and recirculate air through the gin. Because the system employs a hot shelf tower dryer, the conventional introduction and circulation of hot air from a burner and fan assembly, after the primary burner, is no longer necessary. Instead, the hot shelf tower dryer may adjust the moisture content of the cotton through its heated shelves, the shelves being internally heated by hot air provided by a burner and fan assembly. The provision of the hot shelf tower dryer reduces the need for new air and limits the expulsion of trash into the atmosphere caused by conventional drying methods, because the heated air is recirculated within the system.

To convey the cotton, the closed loop push/pull system includes, for example, a first fan, positioned before the hot shelf tower dryer of the cotton gin, that provides an air stream conveying the cotton toward the dryer. The temperature of this air stream is not critical, because, unlike conventional dryers, it is the exposure of the cotton to the heated shelves of the dryer that adjusts the moisture content of the cotton. The air stream continues to convey the cotton to a cleaner or extractor of the cotton gin, so that trash may be separated from the cotton. Once separated, the air stream continues to convey the cleaned cotton for further ginning, while the separated trash travels to a collector of the cotton gin that separates the trash from the air stream conveying it. At minimum, the system further includes a second fan, positioned after the collector, that generates an air stream that withdraws the separated air from the collector and conveys it to a filtering system, in order to clean the air. The cleaned air then continues from the filtering system for recirculation through the system. As described below and illustrated in FIGS. 1 and 2, the number of fans employed by the system depends upon the number of dryers, cleaners/extractors, and collectors used in the cotton gin.

Figure 1:
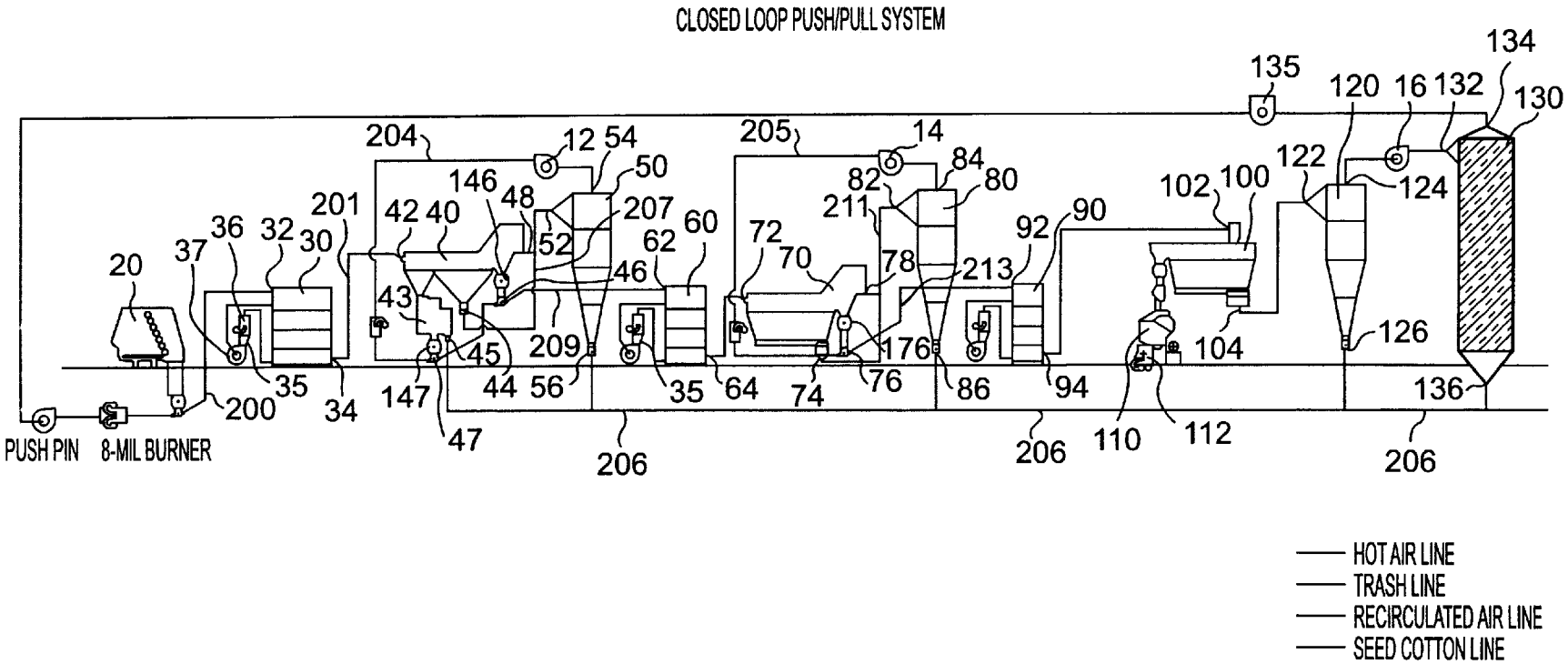
FIG. 1 is a side view illustration of a first embodiment of a closed loop push/pull system according to the present invention.

For example, a first embodiment of the closed loop push/pull system of the present invention is depicted in FIG. 1. As illustrated, the closed loop push/pull system includes a plurality of hot shelf tower dryers and fans, each uniquely positioned to convey cotton and recirculate air throughout the cotton gin. Unlike conventional drying methods, the hot shelf tower dryer reduces the need for the expulsion of heated air, because much of the heated air remains within the shelves of the dryer, unexposed to the cotton. Since such an air stream does not capture small trash or lint resident in the cotton, it may be recirculated between the dryer shelves and the burner and fan assembly, without introducing fire hazards.

Additionally, instead of using the heated air circulating between the shelves of the dryer to convey the cotton, the cotton may travel through the gin as conveyed by independent air streams generated by fans. Because these air streams need not provide heat to dry the cotton (as the heated dryer shelves adjust the cotton moisture content), much of the air used to convey the cotton may also be recirculated between the fans. Essentially, by limiting conventional drying methods and by reducing the need for new air entering into each burner, the expulsion of multiple air streams into the atmosphere is better controlled. And the recirculation of the heated air and the conveying air within the system further reduces the pollutant emissions of the cotton gin.

As shown in the preferred embodiment illustrated in FIG. 1, the cotton ginning process generally begins with the entrance of cotton into the gin through module feeder 20. The cotton descends from module feeder 20 into conduit 200. Conduit 200 includes an air stream, generated by first fan 10. The air stream conveys the cotton to hot shelf tower dryer 30 through conduit 200, which extends from module feeder 20 to inlet 32 of dryer 30.

Hot shelf tower dryer 30 may be any type of hot shelf tower dryer, such as those described in U.S. Pat. Nos. 5,233,764, 6,147,327, and 6,202,258 B1, which are incorporated by reference herein for their disclosures of hot shelf tower dryers. As described in these patents, dryer 30 serves to adjust the moisture content of the cotton in order to facilitate cleaning of the cotton. Heat is provided in the shelves of tower dryer 30 through a burner and fan assembly 35 that houses a burner 36 and fan 37, as described in the incorporated patents. Alternatively, if the cotton becomes too dry following ginning, dryer 30 may adjust the moisture content of the cotton by adding moisture as well as heat to the cotton, as described in U.S. Pat. No. 6,202,258 B1. Regardless of the particular characteristics of the hot shelf tower dryer used, the hot air generated by burner 36 and fan 37 circulates within the shelves of dryer 30. The cotton, therefore, is not directly exposed to this hot air, as the hot air generally remains in the shelves of tower dryer 30. Because this heated air stream does not capture any lint or trash from the cotton, it may be recirculated through burner 36 and fan 37, creating a continuous cycle between the shelves and the burner and fan assembly 35. The provision of hot shelf tower dryer 30 therefore limits the need for conventional drying methods that require new air and the expulsion of trash into the atmosphere.

The air stream generated by fan 10 continues to convey the cotton from dryer 30 to cleaner 40 through conduit 201, which extends from dryer outlet 34 to cleaner inlet 42. Cleaner 40 may be any type of cleaner, although it is preferred that its design, configuration, and operation mirror that of the cleaners described in U.S. Pat. No. 6,038,741, which is incorporated herein by reference for its disclosure of cleaners. Cleaner 40 serves to remove trash, i.e., sticks and other debris, from the cotton by conveying it over grids having openings or slots designed to remove trash. A detailed description of the grid design is provided in incorporated U.S. Pat. No. 6,038,741. Preferably, the first few grids of cleaner 40 include oversized openings or slots in order to allow the cotton containing sticks and larger debris, to descend downward to extractor 43.

Extractor 43 may be any type of extractor, although it is preferred that its design, configuration, and operation mirror that of the extractors described in U.S. Pat. No. 6,038,741, which is incorporated herein by reference for its disclosure of extractors. Extractor 43 removes large debris from the cotton and expels the removed debris through an outlet 45, leading to trash line 206. Extractor 43 also conveys the cleaned cotton through a cross flow box 147. Cross flow box 147 serves to separate the cotton from the air conveying it, allowing the cotton to descend downward through cross flow box 147 to an outlet 45 for further ginning. Any conventional or later developed cross flow box may be used provided that it facilitates the separation of the cotton from the air stream.

The balance of the cotton not descending through the first few grids of cleaner 40 continues through cleaner 40 to the remaining grids, whose openings or slots remove smaller debris from the cotton. This debris, once removed from the cotton, exits cleaner 40 through outlet 44 and travels to collector 50, via conduit 207. Meanwhile, the cleaned cotton travels to a cross flow box 146, so that the cotton may be separated from the air stream conveying it. After separation, the cotton exits cleaner 40 through outlet 46 for further ginning, while the air stream exits cleaner 40 through outlet 48 to continue to collector 50.

Collector 50 receives the air stream and smaller debris through an inlet 52. Collector 50 serves to separate the debris or trash from the air stream conveying it. The trash falls to the bottom of collector 50 through a vacuum air seal. The vacuum air seal generally ensures that the air stream remains in the collector, while the trash and other debris descend downward through the vacuum. Any conventional or later developed vacuum air seal may be used provided that it facilitates the separation of the trash from the air stream. The trash, once passing through the vacuum air seal, descends to outlet 56, which leads to trash line 206. Unlike conventional collectors that expel the remaining air stream into the atmosphere, the air removed from the trash is pulled by a second fan 12 out of collector 50 through outlet 54. Fan 12 not only pulls the air from collector 50, but also pushes this air forward through conduit 204 in order to recirculate this air through the system. The recirculated air forms an air stream that directs the cotton descending through extractor outlet 47 as well as the cotton descending through cleaner outlet 46 to an inlet 62 of second tower dryer 60, via conduit 209. Preferably, the motive force of fan 12 is limited to only that amount needed to pull the air from collector, as higher amounts may also pull unwanted debris.

The design, configuration, and operation of second hot shelf tower dryer 60 preferably resembles that of tower dryer 30. Again, the heated air generated by the burner and fan assembly 35 recirculates through the shelves of tower dryer 60 to adjust the moisture content of the cotton. The cotton exiting the second tower dryer 60 through an outlet 64 will have an adjusted moisture content that assists in the cotton's continued ginning as it travels to an inlet 72 of cleaner 70. Although cleaner 70 resembles previous cleaner 40 in its design, configuration and operation, unlike cleaner 40, cleaner 70 includes preliminary grids having openings or slots of smaller size than those of cleaner 40. As configured, cleaner 70 removes smaller particles of from the cotton, as the larger debris and trash have already been removed from the cotton by cleaner 40 and extractor 43.

Following their removal from the cotton, the smaller particles of trash exit cleaner 70 through outlet 74, while the remaining cotton travels to a cross flow box 176, so that the cleaned cotton may be separated from the air stream conveying it. Once separated, the cotton exits cleaner 70 through outlet 76 for further ginning, while the air stream exits cleaner 70 through outlet 78, where it combines with the trash expelled through cleaner outlet 74, for conveyance to collector 80, through conduit 211.

Similar to collector 50 in its design, configuration, and operation, collector 80 separates the trash from the air stream conveying it and descends the trash through a vacuum air seal to outlet 86, leading to trash line 206. Third fan 14, similar to fan 12, pulls the separated air from an outlet 84 of collector 80 and pushes it forward through conduit 205. The recirculated air forms an air stream that directs the cleaned cotton exiting cleaner 70 (through outlets 74 and 76) to an outlet 92 of another tower dryer 90, through conduit 213.

Dryer 90 is similar to dryers 60 and 30 in design, configuration and operation. However, since at this point the cotton has been subjected to considerable processing, dryer 90 may also add moisture to the cotton, as described in U.S. Pat. No. 6,202,258 B1. As such, the cotton exiting tower dryer 90 through an outlet 94 should have an adjusted moisture that facilitates further ginning of the cotton, as it travels to an inlet 102 of cleaner 100. The cotton arriving to cleaner 100 has already been subjected to considerable cleaning. Therefore, in comparison to cleaners 40, 70, the slots or spacings of the grids of cleaner 100 may be sized to remove any remaining small particles of trash from the cotton. Once cleaned, the cotton descends to extractor feeder 110 and then to gin stand 112. The trash removed by cleaner 100 exits through outlet 104 and travels to an inlet 122 of another collector 120. Collector 120, like previous collectors 50, 80, separates the trash, descending it through a vacuum air seal to outlet 126, which leads to trash line 206. The air remaining in collector 120 is pulled by fourth fan 16 from outlet 124 to an inlet 132 of filter house 130, where the air is further cleaned.

Filter house 130 serves to remove the small trash from its accompanying air stream, where the small trash descends downward through outlet 136, leading to trash line 206, and the cleaned air remains and exits filter house 130, through outlet 134, as pulled by fan 135 to complete the closed loop system. Filter house 130 may be any conventional or later developed filter house provided that it facilitates the separation of small debris from the air stream.

Figure 2:
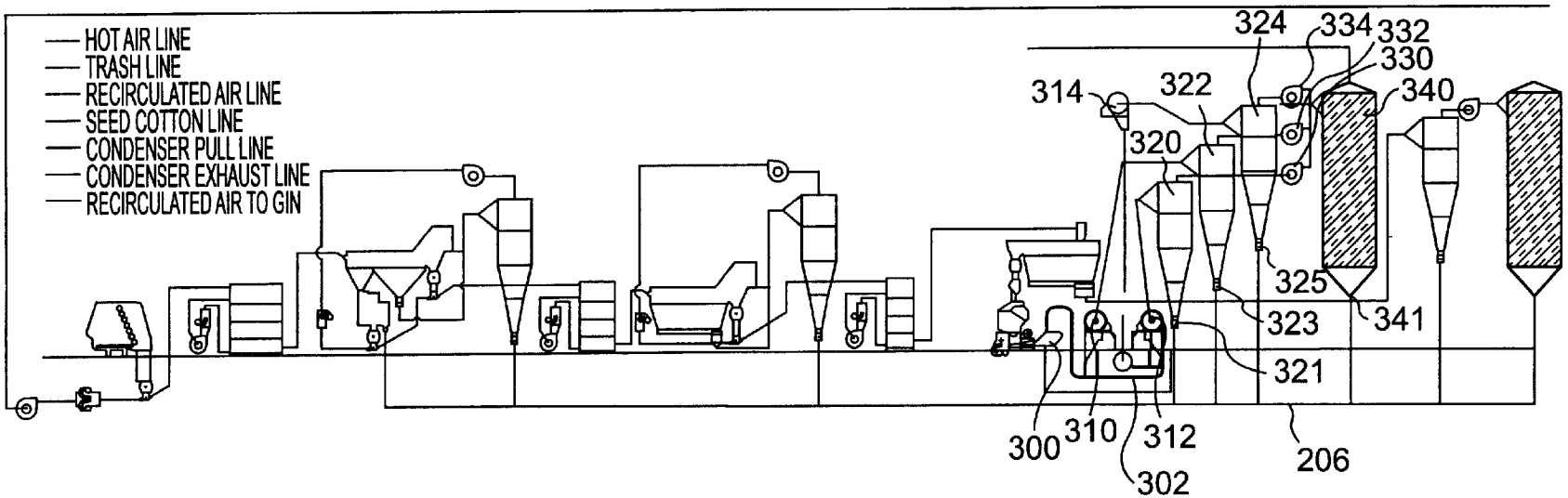
FIG. 2 is a side view illustration of a second embodiment of a closed loop push/pull system according to the present invention.

A second embodiment of the closed loop push/pull system of the present invention is depicted in FIG. 2. In this embodiment, the system again includes hot shelf tower dryers and a plurality of fans for conveying cotton and recirculating air. Compared to the first embodiment, described above and depicted in FIG. 1, the second embodiment differs only by the addition of equipment after gin stand 112.

As depicted in FIG. 2, lint cleaners 300, 302 are positioned after gin stand 112 and receive the cotton after it is processed through gin stand 112. Lint cleaners 300, 302 preferably include small saws capable of removing trash and combing the cotton, after the debris has been removed from the cotton. Lint cleaners 300, 302 remove fine particles, the removal of which adds additional value to the cotton, once baled. The lint or other particles removed by lint cleaner 302 exit through outlets 310, 312 and travel to collectors 320, 322, respectively. Lint cleaners 300, 302 may be any conventional or later developed lint cleaner provided that it facilitates the combing of the cotton.

The cotton, cleaned by lint cleaner 302, travels to battery condenser 314. Battery condenser 314 serves to remove air from the cotton, so that the cotton may be formed into a batt and then conveyed down a lint slide into a bale press. The bale press then presses the batts of cotton into bales. Any trash removed from the cotton during the batting process, exits condenser 314 and travels to collector 324.

Collectors 320, 322, 324, like previous collectors 50, 80, separate the lint and other trash from the air stream conveying it. All of the lint separated from the air streams descends through a vacuum air seal to outlets 321, 323, 325, respectively; each outlet leading to trash line 206. Meanwhile, the air pulled by respective fans 330, 332, 334 travels to filter house 340 for further cleaning. Filter house 340 separates the dust and other particles and descends them to outlet 341, which leads to trash line 206. Meanwhile, the filtered air is recirculated to the gin to provide a source of air for machinery brushes and push/pull fans, thereby, completing the closed loop system.

It will be apparent to those skilled in the art that various modifications and variations can be made to the closed loop push/pull system of the present invention and in construction of this system without departing from the scope or spirit of the invention.

Other embodiments of the invention will be apparent to those skilled in the art from consideration of the specification and practice of the invention disclosed herein. It is intended that the specification and examples be considered as exemplary only with a true scope and spirit of the invention being indicated by the following claims.

What is claimed:

1. A closed loop push/pull system for a cotton gin, comprising:

a hot shelf tower dryer for adjusting the moisture content of cotton;

a cleaner for removing trash from the adjusted moisture cotton;

a dust collector for receiving the removed trash and separating the trash from air conveying the trash;

a push fan positioned in line before the hot shelf tower dryer to provide a first air flow directing the cotton toward the dyer;

a pull fan positioned in line after the collector, the pull fan pulling all of the air separated from the trash in the collector to form a second air flow for recirculation in the system.

2. The closed loop push/pull system of claim 1, wherein the hot shelf tower dryer includes at least one heated shelf and an inlet for receiving the cotton and an outlet for expelling the cotton, the expelled cotton having an adjusted moisture content.

3. The closed loop push/pull system of claim 2, wherein the cleaner includes an inlet for receiving the adjusted moisture content cotton expelled from the hot shelf tower dryer and a first outlet for expelling the cotton and a second outlet for expelling trash removed from the cotton, the expelled cotton being cleaner then the cotton at the cleaner inlet.

4. The closed loop push/pull system of claim 3, wherein the collector includes an inlet for receiving the trash and the air conveying the trash, and a first outlet for expelling the separated air and a second outlet for expelling the separated trash.

5. The closed loop push/pull system of claim 4, wherein the pull fan pulls the separated air from the second outlet of the collector.

6. The closed loop push/pull system of claim 1, wherein the pull fan directs the separated air from the collector toward the push fan, the second air flow combining with the first air flow at the push fan for recirculation.

7. The closed loop push/pull system of claim 6, further comprising a filter house positioned between the pull fan and the push fan, the filter house receiving the separated air conveyed by the pull fan and filtering the separated air and conveying the filtered air to the push fan.

8. The closed loop push/pull system of claim 1, further comprising an extractor for removing trash from the cotton.

9. A method of re-circulating air in a cotton gin, comprising the steps of:

introducing cotton into the cotton gin, the cotton gin having a tower dryer having at least one heated shelf for adjusting the moisture content of the cotton, a cleaner for removing trash from the cotton after the cotton exits the dryer, and a collector for separating the trash from the air conveying the trash and separately expelling the air and the trash;

generating a first air flow using a first fan positioned in line before the tower dryer, the first fan pushing air forward toward the dryer;

generating a second air flow using a second fan positioned in line after the collector, the second fan pulling the air expelled by the collector and pushing the expelled air forward; and recirculating all of the second air flow through the cotton gin.

10. The method of claim 9, wherein the recirculating step includes directing the second air flow from the collector toward the first fan, the second air flow combining with the first air flow at the push fan for recirculation to the tower dryer.

11. The method of claim 9, wherein the recirculating step includes filtering the second air flow before combining the second air flow with the first air flow at the push fan.

12. The method of claim 11, where the filtering step includes further separating trash from the second air flow.

* * * * *

UNITED STATES PATENT AND TRADEMARK OFFICE

CERTIFICATE OF CORRECTION

PATENT NO. : 6,557,213 B1
DATED : May 6, 2003
INVENTOR(S) : William E. Winn

It is certified that error appears in the above-identified patent and that said Letters Patent is hereby corrected as shown below:

Column 7,
Line 53, “dyer;” should read -- dryer; --.

Column 8,
Line 9, “then” should read -- than --.

Signed and Sealed this

First Day of July, 2003

JAMES E. ROGAN
*Director of the United States Patent and Trademark Office*